United States Patent [19]

Kinsey

[11] Patent Number: 5,029,498

[45] Date of Patent: Jul. 9, 1991

[54] NON-SLIP SCREWDRIVER ATTACHMENT

[76] Inventor: Walter J. Kinsey, 246 Mermaids Bite, Naples, Fla. 33940

[21] Appl. No.: 426,238

[22] Filed: Oct. 25, 1989

Related U.S. Application Data

[63] Continuation of Ser. No. 298,648, Jan. 18, 1989, abandoned.

[51] Int. Cl.[5] ..... B25B 23/08

[52] U.S. Cl. ..... 81/451; 81/452

[58] Field of Search ..... 81/451, 452

[56] References Cited

U.S. PATENT DOCUMENTS 657,457 9/1919 Schneider ..... 81/451

768,441 8/1904 Fisher ..... 81/451

2,723,694 11/1955 Ross ..... 81/451

*Primary Examiner*—Frederick R. Schmidt

*Assistant Examiner*—Lawrence Cruz

*Attorney, Agent, or Firm*—Merrill N. Johnson

[57] ABSTRACT

A cylindrical internally contoured sleeve-shaped attachment for a screwdriver designed to prevent the screwdriver from slipping out of a slotted head screw and thereby inflicting injury to the fingers or work piece. A cushioned end prevents any marring of the work piece. This attachment is preferably molded of clear plastic material and has no direct mechanical connection to the screwdriver.

2 Claims, 3 Drawing Sheets

NON-SLIP SCREWDRIVER ATTACHMENT

BACKGROUND AND SUMMARY OF THE INVENTION

This application is a continuation of Ser. No. 07/298,648, now abandoned, filed 1-18-89.

My invention lies in the field of tools, particularly screwdrivers, and provides an attachment designed to make the screwdriver easier and safer to use.

Two problems always exist when using a hand screwdriver for driving a slotted head wood screw. Both exist because of the possibility of the screwdriver slipping out of the slotted head of the wood screw.

One problem is injury to the fingers. The other is the nicking or scratching of the surface of the wood, or other material being attached, or the surrounding area of the surface to which something is being attached.

A problem also exists when turning a machine screw used as an adjusting screw by the screwdriver slipping out of the slotted head of the machine screw. This is expecially true when the screw is not readily accessible, or the device being adjusted is vibrating.

My invention will completely eliminate slipping and thus eliminate the two aforesaid problems.

My invention is a free sliding contoured sleeve-shaped attachment. It had no mechanical connection to the screwdriver.

It could be made of metal on an automatic screw machine when it is not necessary to make the attachment in two halves for use on existing hand screwdrivers for slotted head screws.

However, the attachment lends itself to molding, both for the one piece model and the two piece model, and molding would not doubt be less expensive.

The attachment has an outside diameter about three times the diameter of the steel shank of the screwdriver.

The length of the attachment is dependent on the length of the screw for which it was made. It should be about 75% of the length of the steel shank and tip of the ordinary household screwdriver for a 1½ inch screw.

The upper part of my attachment has an inside diameter just slightly larger than the steel shank of the screwdriver—just sufficient to make it snug but free sliding.

The lower part of my attachment has an inside diameter slightly larger than the broadest part of the tip of the screwdriver.

The portion between the two foregoing diameters, which I have termed the throat is the shape of the upper half of the screwdriver tip, and is the seat for the tip to facilitate the driving process when many of the same length screws are being driven. While this shaped transition portion is not required, it is preferred.

It is, however, not necessary to begin the driving process with the tip seated. The screw may be placed by hand in the lead hole in the work piece, the attachment raised to make the tip of the screwdriver visible, the tip put in the slot of the screw, the attachment lowered to contact the work piece, and then the driving begun.

This same procedure would be used when using the screwdriver with the attachment to turn a machine screw used as an adjusting screw.

However, as previously stated, having the screwdriver seated in the attachment when beginning the driving of a wood screw would facilitate the process especially if many screws of the same length are being driven. It will also aid in driving screws in the horizontal position or overhead.

The attachments will be made for size groupings of screwdrivers and within each group for screws in increments of ¼ of an inch.

The professional would no doubt want a screwdriver with its attachment for each size screw he would use.

For household use the user could have a set of screwdrivers with attachments.

While the cost of the attachments would be the same minimal cost for the professional and the household user, the household user would probably purchase less expensive screwdrivers with their attachments.

For the household user simply wanting to add the attachment to the couple of screwdrivers he already had, the attachment will be made in two identical halves with seating for a ¾ inch screw. The two pieces would simply be glued together by the user.

In addition, one piece adapters will be made in various size increments to slip on the ¾ inch screw attachment to give the capability of driving a longer screw.

The seating of the screwdriver in the attachment will be such that a couple of threads would extend beyond the end of the attachment.

The screw would be placed in the lead hole by hand. The attachment would be put over the screw holding the attachment by the fingers of one hand. The screwdriver would then be turned by the other hand. The attachment will immediately contact the surface of the work piece and remain there until the screw has been driven flush with the surface thus eliminating the possibility of any slipping.

I am aware of only three prior art patents which in any way relate to my invention, namely, U.S. Pat. Nos. 2,141,072, 4,105,056 and 4,190,091.

I am also aware of a product recently being sold known as "slot finder screwdriver bits" for use on an electric power driven tool. Because this product is mechanically attached to the screwdriver bit by a spring and is used to facilitate placing the bit into the slot in the head of the screw, the product is patentably distinct from my invention.

BRIEF DESCRIPTION OF THE DRAWINGS

The appended drawings illustrate a preferred embodiment of my invention for eliminating the slipping of a screwdriver out of slotted head screws.

Figure 2:
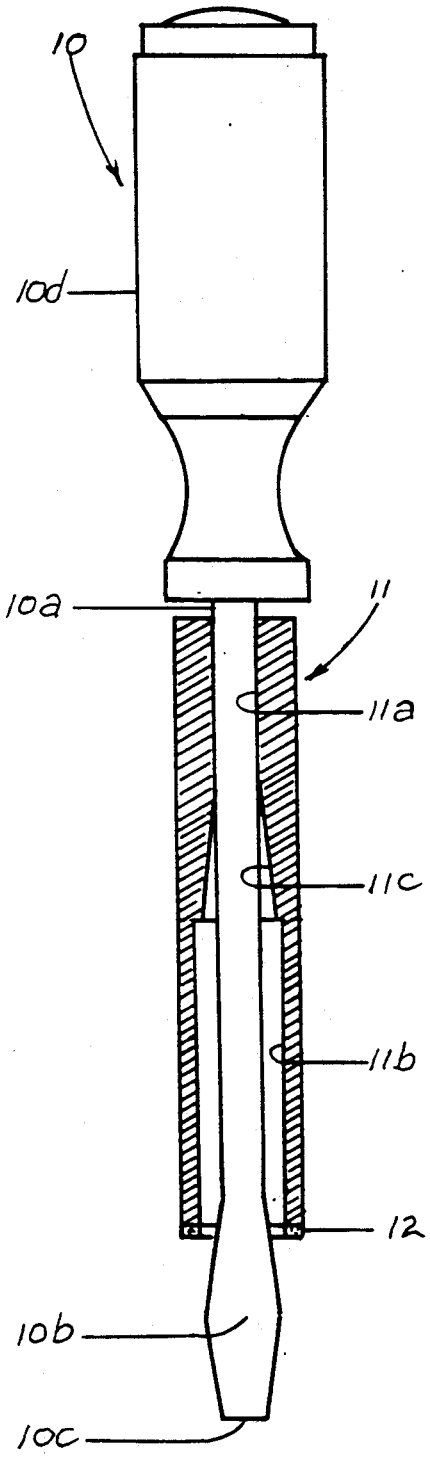
FIG. 2 is a cross-sectional view of my attachment cutting the attachment lengthwise at the mid point, showing the attachment in its up position on the screwdriver.

FIG. *7a* is a view similar to that shown in FIG. 2 but with the sleeve lowered to rest on the work piece as the driving process begins.

FIG. *7b* shows the screw being driven part way.

Figure 7A:
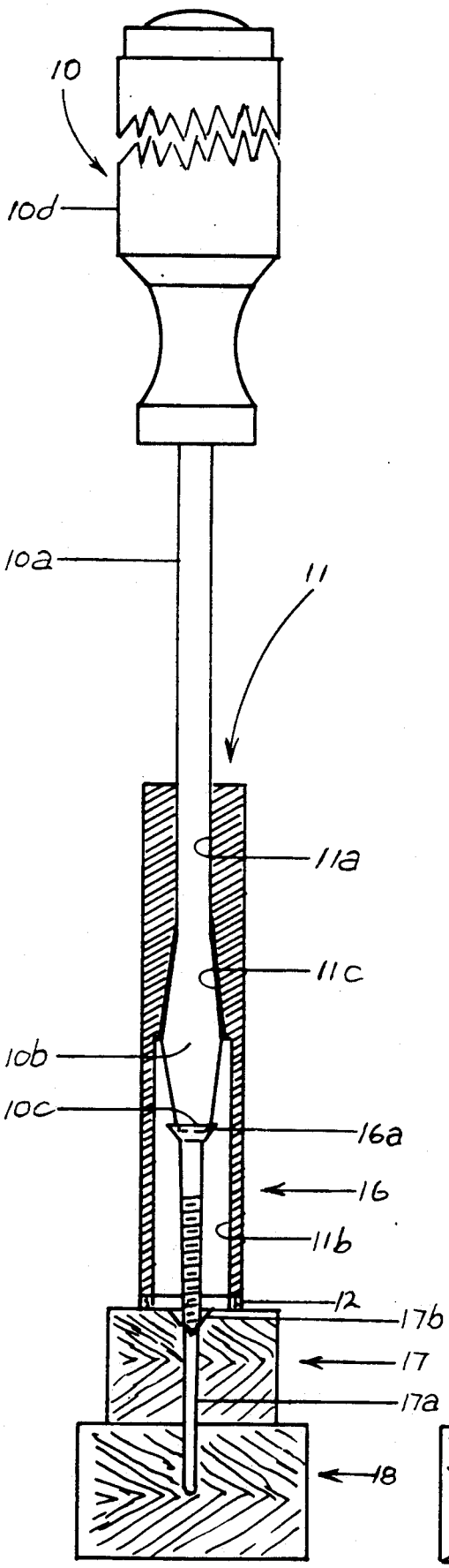
Figure 7B:
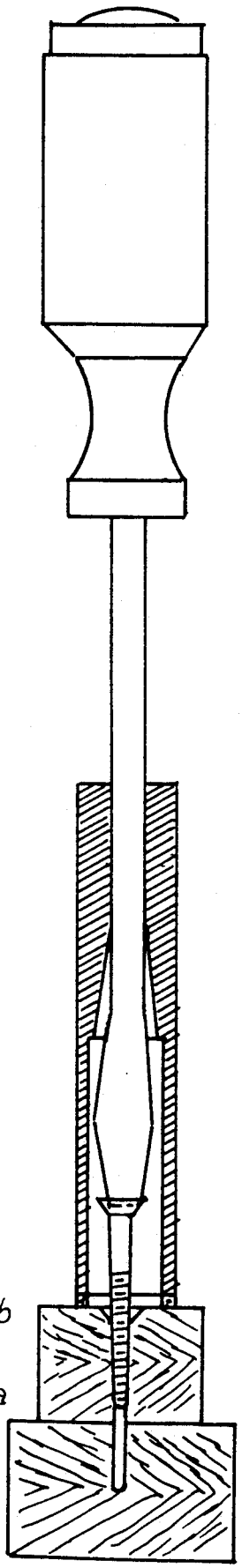
Figure 7C:
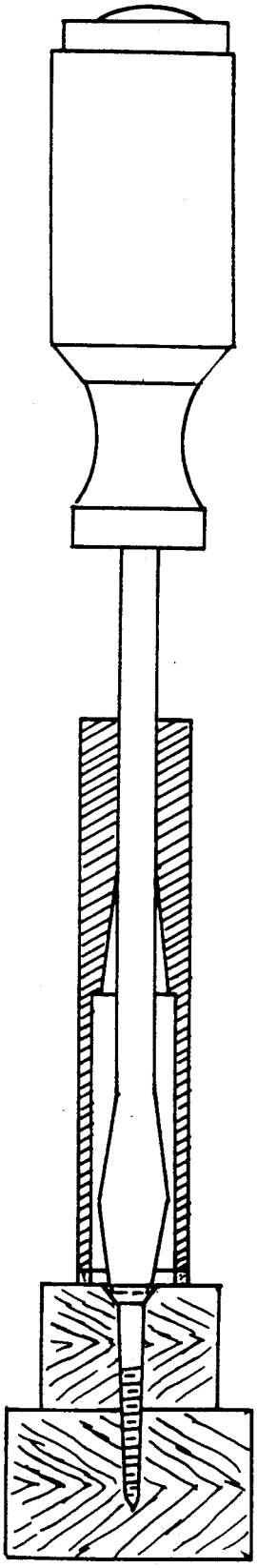

FIG. 7c shows the screw driven flush with the work piece.

DETAILED DESCRIPTION OF THE PREFERRED EMBODIMENT

Figure 1:
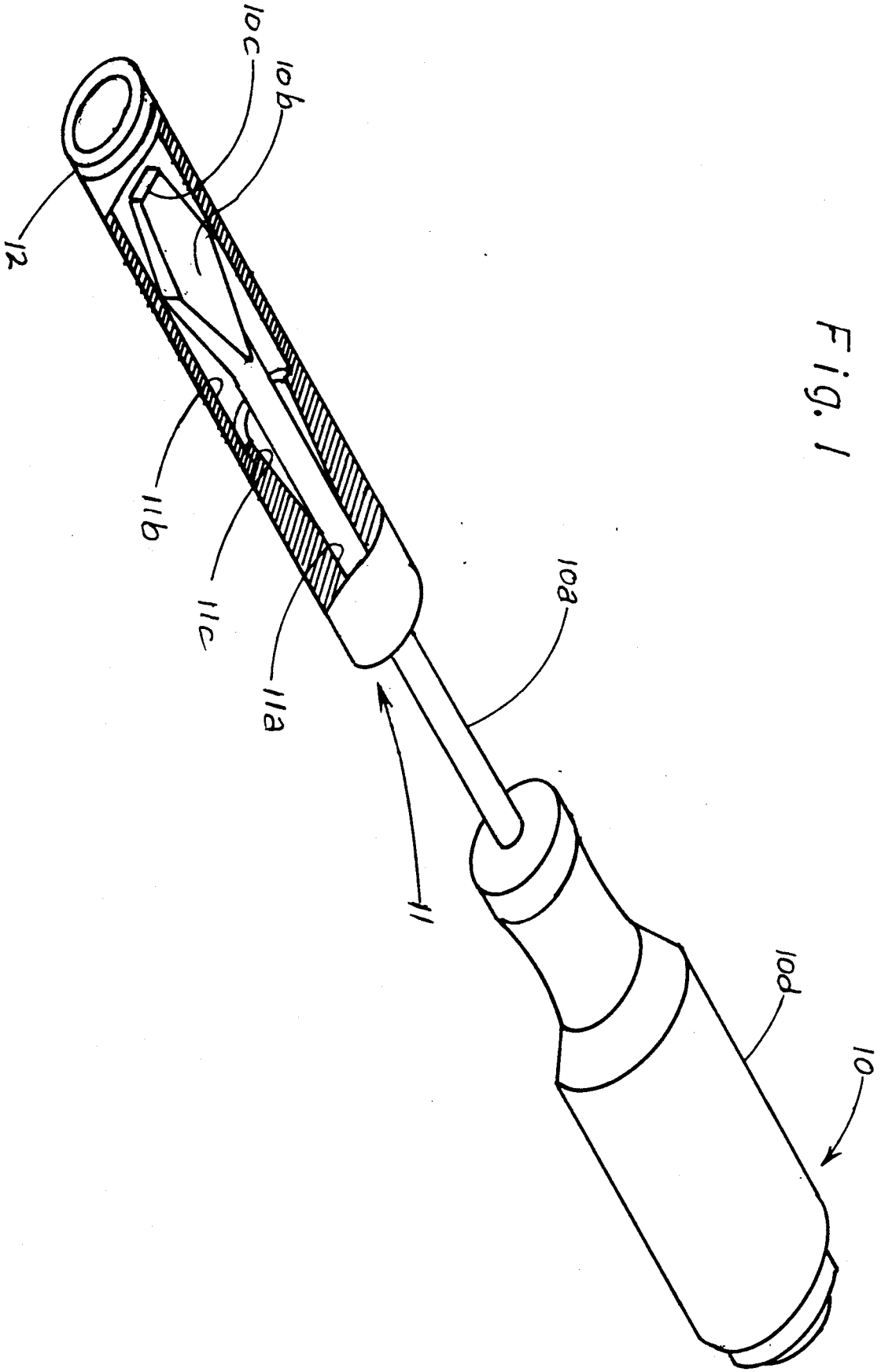
FIG. 1 is a cut away perspective view taken from above of my invention. The screwdriver is conventional and forms no part of my invention and is included only to better show my invention and how it relates to the screwdriver.

Referring to the drawings, FIG. 1 is a perspective view of my contoured sleeve attachment 11 in a forward position on a conventional screwdriver 10. The screwdriver forms no part of my invention but is shown to illustrate how my attachment is used on a screwdriver.

The attachment may be molded preferably of clear plastic in one piece and slipped over the shank 10a during the manufacturing process before the handle 10d is attached. If the handle end of the shank 10a is flared, the sleeve 11 would be molded in half sections and glued together after being placed on the shank 10a. A cushioning material 12 is glued to the end of attachment 11 to prevent any marring whatsoever. This half section embodiment would be used for making attachments to add to existing hand screwdrivers.

The attachment may be made of metal on an automatic screw machine, then added to the screwdriver's non-flared shank during the manufacture of the screwdriver, or for use on screwdriver bits driven by an electric driver.

FIG. 2 is the front view of the attachment 11 and screwdriver 10 shown in FIG. 1 with the attachment in cross section.

Since screwdrivers are made in several sizes depending on the size of the screw they are designed to drive, the inside dimensions of the attachments would be different.

The inside diameter of the upper part 11a would be slightly greater than the shank 10a in order to give a tight yet free sliding fit. The inside diameter of the lower part 11b would be a little greater than the widest part of the screwdriver tip 10b to allow free turning of the screwdriver. It could be slightly tapered to aid in mold ejection.

The inside contour of the mid-section 11c would be tapered the same as that of the upper part of the screwdriver's tip from 10b to where the tip meets the shank 10a. I have termed this area the throat. While the throat contour 11c could vary, my preferred embodiment would give better results for repeated seating of the screwdriver.

The outside diameter of the attachment would be determined by the inside diameter of section 11b. It would be a size to give proper wall thickness to section 11b. In all probability there would be only two outside diameters to standardize the gripping for the professional.

Figure 5:
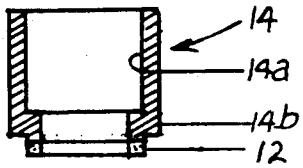
FIGS. 5 and 6 are cross-sectional views of adapters for the attachments designed to increase their screw length capability.
Figure 6:
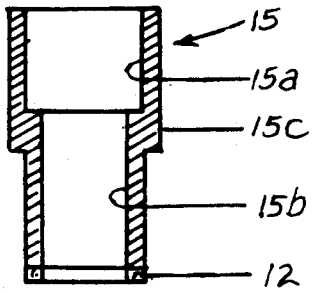

The largest screw #10 could determine the outside diameter of the attachments for #4, #6, #8 and #10 screws and the #16 screw could determine the outside diameter for #12, #14 and #16 screws. This would also standardize the size of the adapters which are shown in FIGS. 5 and 6. The length of section 11a would be about the width of a big thumb.

The depth of section 11b would be determined by the length of the screw for which that particular attachment is designed.

Figure 3:
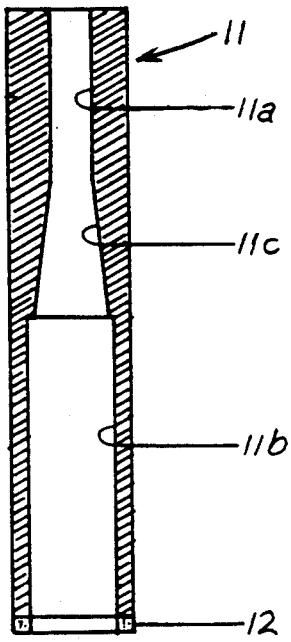
FIG. 3 illustrates in cross-section the same attachment shown in FIG. 2, but without the screwdriver sized for a 1½ inch screw.
Figure 4:
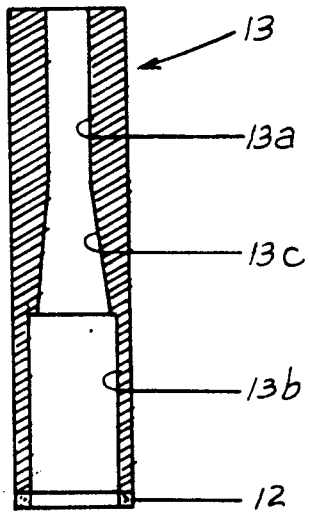
FIG. 4 is the cross-sectional view of an attachment for a ¾ inch screw.

FIG. 3 is a duplicate of the attachment shown in FIG. 2 for comparison with FIG. 4 and to explain how FIGS. 5 and 6 are used. FIG. 3 illustrates an attachment for a 1½ inch screw.

FIG. 4 shows the attachment 13 for a ¾ inch screw in cross section. It will be seen that the length of 13a is the same as the length of 11a the width of a wide thumb.

FIG. 5 shows the cross section of an adapter 14 to lengthen the attachment for a screw ¼ inch longer. The inside diameter of the upper part 14a would be such as to give it a slip fit between 11b or 13b. The inside diameter of 14b would be the same as the inside diameter of 11b and 13b.

The wall thickness of 14a would be the same as 11b and 13b. The wall thickness at 14b would be double this thickness.

The cushioning washer 12 is glued to 14.

FIG. 6 shows in cross section an adapter 15 to lengthen the attachment for a screw 1 inch longer. The inside diameter of the upper part 15a would be such as to give it a slip fit between 11b or 13b.

The inside diameter of 15b would be the same as the inside diameter of 11b and 13b.

The cushioning washer 12 is glued to 15.

Adapter 14 or adapter 15 could be used with attachment 11 or 13. Adapter 14 could be slipped on adapter 15 and the combination used on attachment 13.

FIG. 7a shows a 1½ inch wood screw 16 at the start of driving it into wooden work piece 17 which is to be attached to wooden piece 18. The attachment 11 and wood 17 and 18 are in cross section.

A lead hole 17a has previously been drilled in wood pieces 17 and 18 and 17 countersunk 17b.

The attachment 11 has just been lowered against the work piece 17 with the cushioning washer 12 being against wood piece 17.

Screwdriver tip 10c has dropped into the slot 16a. The driving operation now begins.

FIG. 7b shows all parts as the wood screw 16 has been driven about half way into the wooden work piece 17.

FIG. 7c shows all parts just as the wood screw 16 has been driven flush with the surface of the wooden work piece 17.

It will be seen that during the entire driving operation the attachment 11 with washer 12 glued to it has prevented the screwdriver tip 10c from slipping out of the slot 16a of the screw 16 thus preventing any injury to fingers or the work piece 17.

While two forms of a preferred embodiment of my invention have been described and illustrated, it will be understood that various changes and modifications may be made which fall clearly within the spirit and scope of my invention. It should thus be understood that the foregoing description implies no limitations since the scope of my invention is set forth only in the appended claims.

I claim:

1. A cylindrical internally symetrically contoured sleeve-shaped attachment made of rigid plastic for a screwdriver having a handle, an elongated shank of uniform diameter which is not altered in any way and a blade with a width greater than the diameter of the shank and ending in a screwdriving tip designed for use in driving slotted head screws without the screwdriver slipping out of the screw's slotted head to possibly injure the fingers or mar the surface of the work piece during the placing of the tip of the screwdriver in the slotted head of the screw and during the entire screw driving operation, with the attachment being designed for use with a particular size screwdriver and a particular size screw, in which the upper portion of the sleeve-shaped attachment has an internal diameter slightly larger than the diameter of the shank of the screwdriver, and the lower portion of the attachment has an internal diameter slightly larger than the widest portion of the screwdriver blade, and the throat area between the upper and lower portions of the attachment is taper contoured similarly to the contour of the part of the screwdriver between the shank and the widest portion of the blade, and the attachment surrounds the entire screw prior to the screwdriver's tip being seated in the screw's slotted head and until the screw has been driven to its desired position, and allowing the screwdriver to turn freely within the attachment, and the inside and outside diameters of all parts of the attachment never change due to flexing or other movement, which includes cylindrical adapters, made of rigid plastic, which can be slip-fitted onto the lower end of the attachment to allow the driving of a longer screw than the length of the screw for which that attachment was designed, the adapters being made in various lengths, and the inside diameter of the upper part being such as to allow it to slip-fit over the lower end of the attachment, and the upper part having a pre-determined depth, and the lower part having an inside diameter the same as the attachment, and the lower part having an inside depth equal to the increment of length that adapter will add to the attachment length, with the wall thickness of the adapters being the same as the wall thickness of the lower part of the attachment, except where the two inside diameters meet the wall thickness will be about 2 times that thickness for a short way down the adapter.

2. Attachment and adapters as set forth in claim 1 to which a ring-shaped washer of cushioning materials is attached to the lower end of the attachment and the lower end of the adapters.

* * * * *